US010307888B2

(12) United States Patent
Hoshika et al.

(10) Patent No.: US 10,307,888 B2
(45) Date of Patent: Jun. 4, 2019

(54) SUPERABRASIVE WHEEL

(71) Applicant: A.L.M.T. Corp., Tokyo (JP)

(72) Inventors: Masanori Hoshika, Kato (JP); Hikaru Yamazaki, Kato (JP); Hirohisa Koterasawa, Kato (JP); Kenji Fukushima, Kato (JP)

(73) Assignee: A.L.M.T. Corp., Tokyo (JP)

( * ) Notice: Subject to any disclaimer, the term of this patent is extended or adjusted under 35 U.S.C. 154(b) by 57 days.

(21) Appl. No.: 15/549,612

(22) PCT Filed: Sep. 8, 2016

(86) PCT No.: PCT/JP2016/076454
§ 371 (c)(1),
(2) Date: Aug. 8, 2017

(87) PCT Pub. No.: WO2017/098764
PCT Pub. Date: Jun. 15, 2017

(65) Prior Publication Data

US 2018/0043506 A1 Feb. 15, 2018

(30) Foreign Application Priority Data

Dec. 10, 2015 (JP) ..... 2015-241160

(51) Int. Cl.
*B24D 5/02* (2006.01)
*B24D 3/00* (2006.01)
*B24D 3/06* (2006.01)

(52) U.S. Cl.
CPC ..... *B24D 5/02* (2013.01); *B24D 3/00* (2013.01); *B24D 3/06* (2013.01)

(58) Field of Classification Search
CPC ..... B24D 5/02; B24D 3/00; B24D 3/06
USPC ..... 451/540–547
See application file for complete search history.

(56) References Cited

U.S. PATENT DOCUMENTS 4,925,457 A * 5/1990 deKok ..... B24D 3/06 51/293
4,968,326 A * 11/1990 Wiand ..... B24D 3/06 51/293
5,152,917 A 10/1992 Pieper et al.
5,374,293 A 12/1994 Takashita et al.
5,472,371 A 12/1995 Yamakura et al.
6,190,240 B1 * 2/2001 Kinoshita ..... B24B 53/017 451/443
6,306,025 B1 10/2001 Torii
6,439,986 B1 * 8/2002 Myoung ..... B24B 53/017 451/443
8,777,699 B2 * 7/2014 Sung ..... H01L 23/3732 451/443

(Continued)

FOREIGN PATENT DOCUMENTS

CN 1064830 A 9/1992
CN 1209471 A 3/1999

(Continued)

*Primary Examiner* — George B Nguyen
(74) *Attorney, Agent, or Firm* — Baker Botts L.L.P.; Michael A. Sartori

(57) ABSTRACT

A superabrasive wheel having a superabrasive grain layer having superabrasive grains fixed by a binder, a ratio of an area occupied by the superabrasive grains in the superabrasive grain layer being 20% to 70%.

8 Claims, 3 Drawing Sheets

(56) References Cited

U.S. PATENT DOCUMENTS

| | | | | |
|---|---|---|---|---|
| 2003/0050000 | A1* | 3/2003 | Nonogawa | B24D 3/06 451/544 |
| 2004/0009736 | A1* | 1/2004 | Kawashita | B24B 7/00 451/8 |
| 2007/0218821 | A1* | 9/2007 | Nonoshita | B24B 53/017 451/443 |
| 2008/0271384 | A1* | 11/2008 | Puthanangady | B24B 53/017 51/309 |
| 2010/0248595 | A1* | 9/2010 | Dinh-Ngoc | B24B 37/04 451/56 |
| 2012/0270484 | A1 | 10/2012 | Imai et al. | |
| 2012/0302146 | A1* | 11/2012 | Sung | B24B 53/017 451/443 |
| 2015/0133036 | A1* | 5/2015 | Sung | B24B 53/017 451/56 |

FOREIGN PATENT DOCUMENTS

| | | | |
|---|---|---|---|
| CN | 101066585 | A | 11/2007 |
| CN | 102240989 | A | 11/2011 |
| JP | H05-016070 | A | 1/1993 |
| JP | H05-200670 | A | 8/1993 |
| JP | H06-039729 | A | 2/1994 |
| JP | H08-155749 | A | 6/1996 |
| JP | H08-309666 | A | 11/1996 |
| JP | 2000-024934 | A | 1/2000 |
| JP | 2000-153463 | A | 6/2000 |
| JP | 2000-233370 | A | 8/2000 |
| JP | 2004-358640 | A | 12/2004 |
| JP | 2010-017794 | A | 1/2010 |
| JP | 2011-148083 | A | 8/2011 |
| JP | 5072749 | B2 | 11/2012 |
| KR | 10-1999-071674 | A | 9/2001 |

* cited by examiner

SUPERABRASIVE WHEEL

TECHNICAL FIELD

The present invention relates to a superabrasive wheel. This application claims priority based on Japanese Patent Application No. 2015-241160 filed on Dec. 10, 2015, and incorporates all of the contents described therein by reference.

BACKGROUND ART

A superabrasive wheel comprising on a base metal a superabrasive grain layer having superabrasive grains such as CBN abrasive grains or diamond abrasive grains fixed by metal plating, is disclosed in Japanese Patent Laying-Open Nos. 5-16070 (Patent Document 1), 2000-233370 (Patent Document 2) and 5-200670 (Patent Document 3).

CITATION LIST

Patent Documents

Patent document 1: Japanese Patent Laying-Open No. 5-16070

Patent document 2: Japanese Patent Laying-Open No. 2000-233370

Patent document 3: Japanese Patent Laying-Open No. 5-200670

SUMMARY OF INVENTION

A superabrasive wheel according to one aspect of the present invention is a superabrasive wheel having a superabrasive grain layer having superabrasive grains fixed by a binder, and a ratio of an area occupied by the superabrasive grains in the superabrasive grain layer is 20% to 70%.

[Effect of Present Disclosure]

According to the present disclosure, a superabrasive wheel having a good grinding performance and a long lifetime can be provided.

DESCRIPTION OF EMBODIMENTS

[Description of Embodiment of Present Disclosure]

Figure 1:
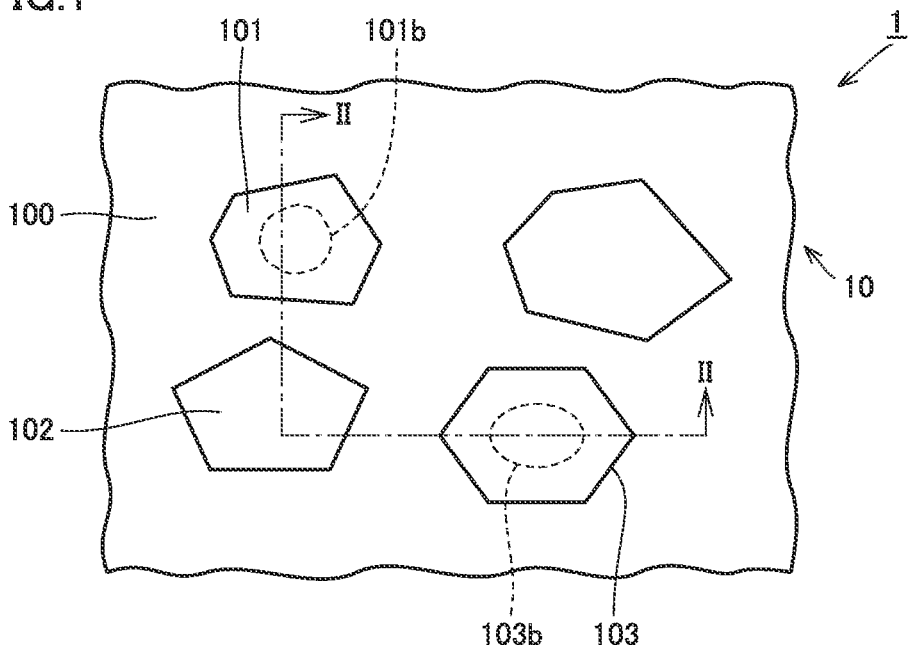
FIG. 1 is a plan view of a superabrasive wheel according to an embodiment.

Initially, an embodiment of the present invention will be enumerated and described.

The inventors of the present invention have conducted an extensive research to solve a problem of an electroplated superabrasive wheel as described above and a brazed type superabrasive wheel, and as a result, the present inventors have succeeded in inventing a superabrasive wheel having a good grinding performance and in addition, a long lifetime.

In a conventional superabrasive wheel, metal plating precipitated on a base metal fills gaps between superabrasive grains and is thus grown. The metal plating is precipitated until it has a thickness allowing it to firmly hold superabrasive grains. As the metal plating, nickel plating is mainly used. The superabrasive wheel thus configured is referred to as an electroplated superabrasive wheel. As the electroplated superabrasive wheel has superabrasive grains fixed in an ideal state with the superabrasive grains having tips sufficiently exposed, it does not require dressing, and has a chip pocket having a large capacity and is hence less clogged with chips, and is extremely excellent in grinding performance, and accordingly, it is widely used for high efficiency grinding and rough grinding.

The above electroplated superabrasive wheel, however, has the superabrasive grains with their tips uneven in height as the superabrasive grains are different in grain size and fixed in postures. This prevents a workpiece from having a surface roughness of high precision, and accordingly, in the field of precision grinding, the electroplated superabrasive wheel is trued and thus used. In that case, as the superabrasive grain layer is a single layer, excessive truing results in a problem reducing grinding performance and lifetime.

A superabrasive wheel of a brazed type comprising on a base metal a superabrasive grain layer having superabrasive grains such as CBN abrasive grains or diamond abrasive grains fixed by a brazing material, is also known. As well as the above electroplated superabrasive wheel, the superabrasive wheel of the brazed type also has the superabrasive grains with their tips uneven in height as the superabrasive grains are different in grain size and fixed in postures. This prevents a workpiece from having a surface roughness of high precision, and accordingly, in the field of precision grinding, the superabrasive wheel of the brazed type is trued and thus used. In that case, however, as the superabrasive grain layer is a single layer, excessive truing results in a problem reducing grinding performance and lifetime.

The present invention has been made to solve the above problem, and contemplates a superabrasive wheel having a good grinding performance and a long lifetime.

An invention made from such findings relates to a superabrasive wheel having a superabrasive grain layer having superabrasive grains fixed by a binder, and a ratio of an area occupied by the superabrasive grains in the superabrasive grain layer is 20% to 70%.

Preferably, the superabrasive grains have an average grain size of 5 μm to 2000 μm.

Preferably, an areal ratio at which the superabrasive grains' tips work on a workpiece is 1% to 30% per unit area of a surface of the superabrasive grain layer.

Preferably, a projection and a depression having a height of 1 μm or more are formed at a tip of the superabrasive grain.

Preferably, the superabrasive grain layer has the superabrasive grains fixed in a single layer, and the binder is metal plating or a brazing material.

Preferably, the binder has a thickness of 30% to 90% of an average grain size of the superabrasive grain.

Preferably, a plurality of the superabrasive grains work on a workpiece, and the plurality of the superabrasive grains working on the workpiece have tips, respectively, having a variation in height of 5 μm or less.

Preferably, the superabrasive wheel is used for precision grinding in which a surface roughness of a workpiece is 5 μm Rz or less.

Preferably, the ratio of the area occupied by the superabrasive grains in the superabrasive grain layer is 30% to 70%.

Preferably, the binder has a thickness of 30% to 80% of an average grain size of the superabrasive grain.

[Detailed Description of Embodiment of the Present Invention]

Figure 2:
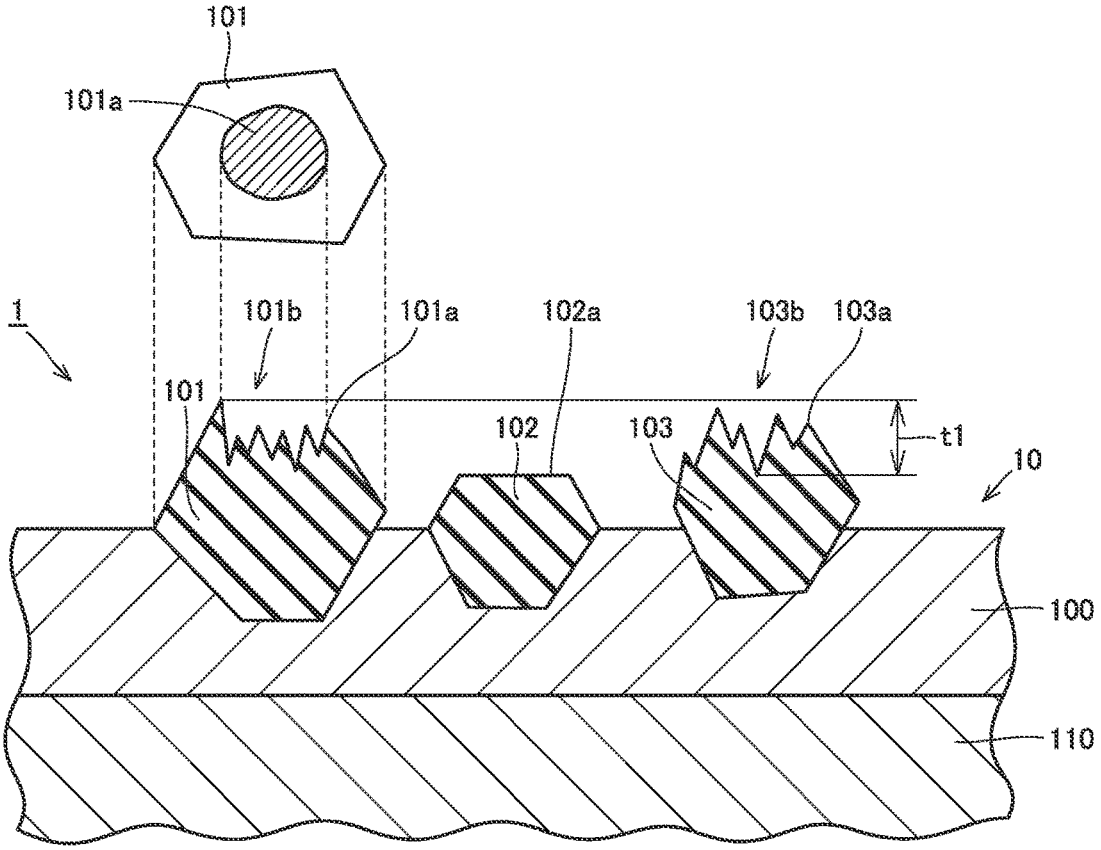
FIG. 2 is a cross-sectional view taken along a line II-II in FIG. 1.
Figure 3:
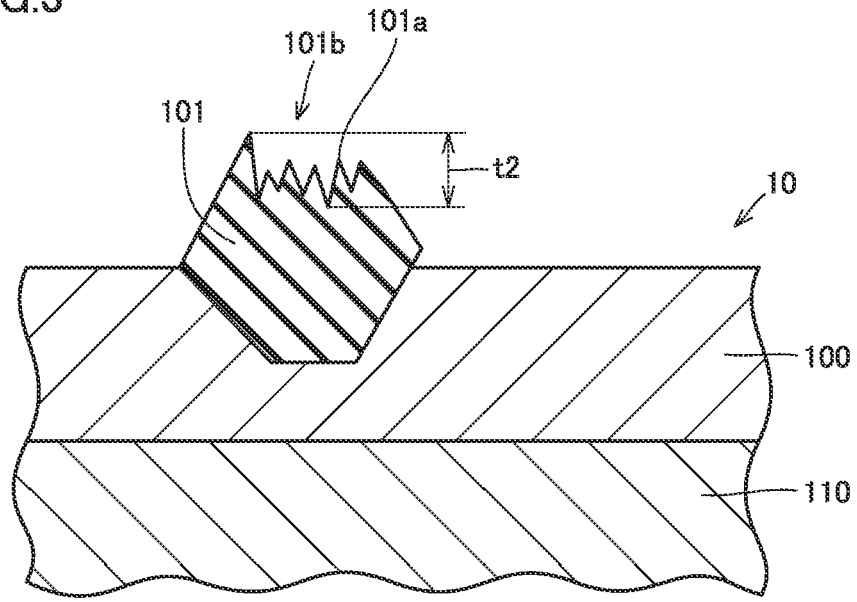
FIG. 3 is an enlarged cross sectional view showing one abrasive grain in FIG. 2.

With reference to FIGS. 1 to 3, a superabrasive wheel 1 is superabrasive wheel 1 having a superabrasive grain layer 10 having superabrasive grains 101, 102, 103 fixed by a binder 100, and a ratio of an area occupied by superabrasive grains 101, 102, 103 in superabrasive grain layer 10 is 20% to 70%. Note that a "ratio of an area occupied . . . " is defined as a ratio of an area occupied by superabrasive grains per unit area of superabrasive grain layer 10 when superabrasive grain layer 10 is observed exactly from above, e.g., per 1 $mm^2$ thereof.

In order to measure a ratio of an area occupied by superabrasive grains 101, 102, 103, initially, a surface of superabrasive grain layer 10 is observed with a SEM (a scanning electron microscope) to obtain electronic data of an image. An image analysis software is used to distinguish superabrasive grains 101, 102, 103 and binder 100. For example, in a field of view of 1000 μm×1000 μm, a ratio of an area occupied by the grains is measured at any three sites and the ratios of the areas occupied by the grains at the three sites are averaged.

When a performance of superabrasive wheel 1, such as grinding performance and lifetime thereof, is considered, a ratio of an area occupied by superabrasive grains 101, 102, 103 is preferably 30% to 70%, more preferably 35% to 70%.

Preferably, superabrasive grains 101, 102, 103 have an average grain size of 5 μm to 2000 μm. To measure the average grain size, for example, binder 100 is melted and superabrasive grains 101, 102, 103 are removed from superabrasive wheel 1. When superabrasive wheel 1 is small, superabrasive grains 101, 102, 103 are removed from the entirety of superabrasive wheel 1. When superabrasive wheel 1 is large, it may be difficult to remove superabrasive grains 101, 102, 103 from the entirety of superabrasive wheel 1. In that case, a portion equal to or greater than an area of 25 $mm^2$ or more is stripped off superabrasive grain layer 10. Superabrasive grains 101, 102, 103 are removed from the portion stripped off. The average grain size of superabrasive grains 101, 102, 103 is measured with a laser diffraction type grain size distribution measuring instrument (for example, the SALD series manufactured by Shimadzu Corporation).

Preferably, an areal ratio at which tips 101*a* and 103*a* of superabrasive grains 101 and 103 work on a workpiece is 1% to 30% per unit area of a surface of superabrasive grain layer 10. Note that an areal ratio at which tips 101*a* and 103*a* of superabrasive grains 101 and 103 work on a workpiece is defined as an areal ratio at which tips 101*a* and 103*a* of superabrasive grains 101 and 103 work on the workpiece per unit area of superabrasive grain layer 10 when superabrasive grain layer 10 is observed exactly from above, e.g., per 1 $mm^2$ thereof. To measure an areal ratio at which tips 101*a* and 103*a* of superabrasive grains 101 and 103 work on a workpiece, a surface of superabrasive grain layer 10 is observed with a SEM (a scanning electron microscope) to obtain electronic data of an image and an image analysis software is used to obtain an areal ratio of surfaces of tips 101*a* and 103*a* of superabrasive grains 101 and 103 working on the workpiece to thus calculate it. Superabrasive grain 102 has a tip 102*a*, which does not have a depression or a projection, and is thus not used for machining. Accordingly, the area of tip 102 is not an area contributing to machining.

Preferably, superabrasive grains 101, 103 have tips 101*a* and 103*a* with a depression and a projection 101*b* and 103*b* having a height of 1 μm or more. To allow the superabrasive wheel to obtain a satisfactory grinding performance, the tip more preferably has depression and projection 101*b* and 103*b* of 2 μm or more, most preferably 3 μm or more.

The size of depression and projection 101*b* and 103*b* of tips 101*a* and 103*a* can be measured with a laser microscope which is excellent in measuring complicated microscopic shapes and enables observation and measurement of a three-dimensional surface shape of a sample in a non-contact manner. As the laser microscope, for example, a 3D measuring laser microscope OLS series manufactured by Olympus Corporation, and a shape analysis laser microscope VX series manufactured by Keyence Corporation can be used.

As shown in FIG. 3, depression and projection 101*b* has a height t2, which indicates a difference in level of depression and projection 101*b* between the highest portion and the lowest portion.

Preferably, superabrasive grain layer 10 has superabrasive grains 101, 102, 103 fixed in a single layer, and binder 100 is metal plating or a brazing material. Metal plating or a brazing material can be used as the binder. As the metal plating, nickel plating is suitable, and as the brazing material, a brazing material of silver is suitable.

Preferably, binder 100 has a thickness of 30% to 90% of an average grain size of superabrasive grains 101,102,103. The superabrasive wheel is such that binder 100 has a thickness of 30% to 90% of the average grain size of superabrasive grains 101, 102, 103. To allow binder 100 to hold superabrasive grains with an increased force, and to also obtain satisfactory wheel performance, binder 100 more preferably has a thickness of 30% to 80%, most preferably 30% to 70% of the average grain size of superabrasive grains 101, 102, 103.

As shown in FIG. 2, preferably, a plurality of superabrasive grains 101, 102, 103 work on a workpiece, and tips 101*a*, 103*a* of the plurality of superabrasive grains 101, 102, 103 working on the workpiece have a variation t1 in height of 5 μm or less. More preferably, tips 101*a*, 103*a* of superabrasive grains 101, 102, 103 working on the workpiece have variation t1 in height of 4 μm or less. Variation t1 is most preferably 3 μm or less. Variation in height of tips of superabrasive grains working on a workpiece can be measured with a shape analysis laser microscope (for example, a laser microscope in the VX series manufactured by Keyence Corporation). Variation t1 represents a difference in height of depression and projection 101*b* and 103*b* between the highest portion and the lowest portion. To measure the variation, for example, a surface of superabrasive grain layer 10 of an area of 1 $mm^2$ is three-dimensionally measured and working superabrasive grains 101, 102, 103 are analysed in cross section to measure depression and projection, and a difference in height of depression and projection between the highest portion and the lowest portion is defined as the variation.

Preferably, the superabrasive wheel is used for precision grinding in which a workpiece's surface roughness is 5 μm Rz or less. Surface roughness (Rz: ten point height of irregularities) is measured based on JIS B 0610 (2001).

EXAMPLE 1

Electroplated CBN grinding wheels of Sample Nos. 1-20 were produced as follows.

Initially, in a base metal masking step, a masking material such as a masking tape or a masking coating agent was used to mask the entire surface of the base metal except for a surface on which a superabrasive grain layer was to be formed.

Subsequently, in a nickel plating step, in a plating bath in which CBN abrasive grains were uniformly dispersed, a nickel plating was precipitated at a portion of a surface of the base metal that was not masked, and the nickel plating filled gaps between super-abrasive grains and was thus grown, and until the nickel plating had a thickness allowing it to hold the CBN abrasive grains, the nickel plating was precipitated to provide a complete, single CBN abrasive grain layer.

Subsequently, in a masking removal step, the masking material such as the masking tape or the masking coating agent was removed.

While an electroplated CBN grinding wheel thus produced had CBN abrasive grains with tips projecting sufficiently more than the nickel plating layer and was outstanding in grinding performance, the CBN abrasive grains had tips uneven in height as the CBN abrasive grains were different in grain size and fixed in postures.

Subsequently, a truer was used to perform truing to thus produce the electroplated CBN grinding wheels shown in Table 1.

roughness exceeding Rz 7 μm. It has been found that a wheel with assessment A shows an extremely excellent effect. It has been found that a wheel with assessment B shows an excellent effect. It has been found that a wheel with assessment C is unusable for practical use.

Table 1 under the column "wheel performance" has a subordinate column "grinding performance," and therein assessment A indicates that a workpiece was not burnt. Assessment C indicates that a workpiece was apparently burnt. It has been found that a wheel with assessment A shows an extremely excellent grinding performance. It has been found that although a wheel with assessment C burns a workpiece, the wheel can be used in a field where burning is not a problem.

In a column "lifetime," assessments are defined as follows:

When a grinding process using the wheel of each sample number ends, a lifetime of the wheel is estimated from a shape of a tip. Assessment A indicates a relative lifetime of "0.8 or more" when sample No. 1 has a lifetime of "1".

TABLE 1

| sample no. | ratio of area occupied by superabrasive grains (%) | average grain size of superabrasive grain (μm) | areal ratio of working tip (%) | difference in level between projection & depression of tip of superabrasive grain (μm) | thickness of binder relative to average grain size (%) | variation in height of tips working on workpiece (μm) | wheel performance: surface roughness of workpiece | wheel performance: grinding performance | wheel performance: lifetime |
|---|---|---|---|---|---|---|---|---|---|
| 1 | 50 | 120 | 0.5 | 2 | 60 | 3 | B | A | A |
| 2 | 50 | 120 | 1 | 1 | 60 | 2 | A | A | A |
| 3 | 50 | 120 | 2 | 1 | 60 | 3 | A | A | A |
| 4 | 50 | 120 | 2 | 1 | 60 | 2 | A | A | A |
| 5 | 50 | 120 | 2 | 1 | 60 | 1 | A | A | A |
| 6 | 50 | 120 | 5 | 1 | 60 | 1 | A | A | A |
| 7 | 50 | 120 | 5 | 2 | 60 | 1 | A | A | A |
| 8 | 50 | 120 | 5 | 8 | 60 | 5 | A | A | A |
| 9 | 50 | 120 | 8 | 1 | 60 | 1 | A | A | A |
| 10 | 50 | 120 | 8 | 2 | 60 | 1 | A | A | A |
| 11 | 50 | 120 | 8 | 8 | 60 | 5 | A | A | A |
| 12 | 50 | 120 | 15 | 1 | 60 | 1 | A | A | A |
| 13 | 50 | 120 | 15 | 2 | 60 | 1 | A | A | A |
| 14 | 50 | 120 | 15 | 8 | 60 | 1 | A | A | A |
| 15 | 50 | 120 | 20 | 2 | 60 | 2 | A | A | A |
| 16 | 50 | 120 | 25 | 2 | 60 | 2 | A | A | A |
| 17 | 50 | 120 | 30 | 2 | 60 | 2 | A | A | A |
| 18 | 50 | 120 | 33 | 1 | 60 | 2 | B | A | A |
| 19 | 50 | 120 | 35 | 1 | 60 | 2 | B | A | A |
| 20 | 10 | 120 | 2 | 1 | 60 | 2 | C | C | D |

The wheels underwent a grinding test to grind workpieces under conditions indicated below, and the workpieces had surface roughnesses as shown in Table 1.

Further, the workpieces and the wheels had their respective surfaces observed to assess grinding performance and lifetime.

Workpiece: Steel (hardness: HRC55)

Wheel's peripheral speed: 50 m/s

Feed rate: 600 mm/min

Grinding test period of time: 5 hours

Table 1 has a column "wheel performance" and thereunder a subordinate column "workpiece surface roughness," and therein an assessment A indicates that a workpiece had a surface roughness of Rz 5 μm or less. An assessment B indicates that a workpiece had a surface roughness exceeding Rz 5 μm and equal to or less than Rz 7 μm. An assessment C indicates that a workpiece had a surface Assessment D indicates a relative lifetime "less than 0.4" when sample No. 1 has a lifetime of "1".

It has been found that a wheel with assessment A shows an extremely excellent lifetime. It has been found that a wheel with assessment D is unusable for practical use.

From Table 1, it has been found that the superabrasive wheels of Sample Nos. 1-19 are excellent in at least one of workpiece surface roughness, grinding performance and lifetime.

EXAMPLE 2

Electroplated CBN grinding wheels of Sample Nos. 30-34 shown in table 2 were produced in a method similar to that in example 1. Note that sample No. 35 had excessively many superabrasive grains, and was unable to produce an electroplated CBN grinding wheel.

TABLE 2

| sample no. | ratio of area occupied by superabrasive grains (%) | average grain size of superabrasive grain (μm) | areal ratio of working tip (%) | difference in level between projection & depression of tip of superabrasive grain (μm) | thickness of binder relative to average grain size (%) | variation in height of tips working on workpiece (μm) | wheel performance: surface roughness of workpiece | wheel performance: grinding performance | wheel performance: lifetime |
|---|---|---|---|---|---|---|---|---|---|
| 30 | 70 | 140 | 15 | 1 | 50 | 2 | A | B | A |
| 31 | 50 | 140 | 10 | 1 | 50 | 2 | A | A | A |
| 32 | 30 | 140 | 7 | 1 | 50 | 2 | A | A | A |
| 33 | 20 | 140 | 5 | 1 | 50 | 2 | B | A | B |
| 34 | 18 | 140 | 4 | 1 | 50 | 2 | C | A | C |
| 35 | 72 (not producible) | | | | | | | | |

The wheels underwent a grinding test to grind workpieces under conditions indicated below, and the workpieces had surface roughnesses as shown in Table 2.

Further, the workpieces and the wheels had their respective surfaces observed to assess grinding performance and lifetime.

Workpiece: Steel (hardness: HRC55)

Wheel's peripheral speed: 50 m/s

Feed rate: 600 mm/min

Grinding test period of time: 5 hours

Table 2 has a column "wheel performance" and thereunder a subordinate column "workpiece surface roughness," and therein assessment A indicates that a workpiece had a surface roughness of Rz 5 μm or less. Assessment B indicates that a workpiece had a surface roughness exceeding Rz 5 μm and equal to or less than Rz 7 μm. Assessment C indicates that a workpiece had a surface roughness exceeding Rz 7 μm. It has been found that a wheel with assessment A shows an extremely excellent effect. It has been found that a wheel with assessment B shows an excellent effect. It has been found that a wheel with assessment C is unusable for practical use.

Table 2 under the column "wheel performance" has a subordinate column "grinding performance," and therein assessment A indicates that a workpiece was not burnt. Assessment B indicates that a workpiece was slightly burnt. It has been found that a wheel with assessment A shows an extremely excellent grinding performance. It has been found that a wheel with assessment B shows an excellent grinding performance.

In a column "lifetime," assessments A-C are defined as follows:

When a grinding process using the wheel of each sample number ends, a lifetime of the wheel is estimated from a shape of a tip. Assessment A indicates a relative lifetime of "0.8 or more" when sample No. 31 has a lifetime of "1". Assessment B indicates a relative lifetime "less than 0.8" when sample No. 31 has a lifetime of "1". Assessment C indicates a relative lifetime "less than 0.6" when sample No. 31 has a lifetime of "1".

It has been found that a wheel with assessment A shows an extremely excellent lifetime. It has been found that a wheel with assessment B shows an excellent lifetime. It has been found that a wheel with assessment C shows a normal lifetime.

From Table 2, it has been found that it is necessary to have a superabrasive grain-occupied area ratio of 20% or more and 70% or less, preferably 30% or more and 70% or less. While sample No. 34 having a superabrasive grain-occupied area ratio of 18% was preferable in grinding performance, it was poor in surface roughness and lifetime.

EXAMPLE 3

Electroplated CBN grinding wheels of Sample Nos. 40-44 shown in table 3 were produced in a method similar to that in example 1.

TABLE 3

| sample no. | ratio of area occupied by superabrasive grains (%) | average grain size of superabrasive grain (μm) | areal ratio of working tip (%) | difference in level between projection & depression of tip of superabrasive grain (μm) | thickness of binder relative to average grain size (%) | variation in height of tips working on workpiece (μm) | wheel performance: surface roughness of workpiece | wheel performance: grinding performance | wheel performance: lifetime |
|---|---|---|---|---|---|---|---|---|---|
| 40 | 50 | 5 | 10 | 1 | 40 | 1 | A | B | B |
| 41 | 50 | 540 | 10 | 2 | 40 | 2 | A | A | A |
| 42 | 50 | 1010 | 10 | 2 | 40 | 2 | A | A | A |
| 43 | 50 | 1560 | 10 | 2 | 40 | 2 | A | A | A |
| 44 | 50 | 2000 | 10 | 2 | 40 | 2 | B | A | A |

The wheels underwent a grinding test to grind workpieces under conditions indicated below, and the workpieces had surface roughnesses as shown in Table 3.

Further, the workpieces and the wheels had their respective surfaces observed to assess grinding performance and lifetime.

Workpiece: Steel (hardness: HRC55)

Wheel's peripheral speed: 60 m/s

Feed rate: 620 mm/min

Grinding test period of time: 5 hours

This cutting condition was a severe grinding condition because it is a higher peripheral wheel speed and a higher feed rate than in Example 1. Table 3 has a column "wheel performance" and thereunder a subordinate column "workpiece surface roughness," and therein assessment A indicates that a workpiece had a surface roughness of Rz 5 μm or less. Assessment B indicates that a workpiece had a surface roughness exceeding Rz 5 μm and equal to or less than Rz 7 μm. It has been found that a wheel with assessment A shows an extremely excellent effect. It has been found that a wheel with assessment B shows an excellent effect.

Table 3 under the column "wheel performance" has a subordinate column "grinding performance," and therein assessment A indicates that a workpiece was not burnt. Assessment B indicates that a workpiece was slightly burnt. It has been found that a wheel with assessment A shows an extremely excellent grinding performance. It has been found that a wheel with assessment B shows an excellent grinding performance.

In a column "lifetime," assessments A and B are defined as follows:

When a grinding process using the wheel of each sample number ends, a lifetime of the wheel is estimated from a shape of a tip. Assessment A indicates a relative lifetime of "0.8 or more" when sample No. 41 has a lifetime of "1". Assessment B indicates a relative lifetime "less than 0.8" when sample No. 41 has a lifetime of "1".

It has been found that a wheel with assessment A shows an extremely excellent lifetime. It has been found that a wheel with assessment B shows an excellent lifetime.

From Table 3, a superabrasive grain having an average grain size of 5 μm to 2000 μm is preferable.

EXAMPLE 4

Electroplated CBN grinding wheels of Sample Nos. 50 and 51 shown in table 4 were produced in a method similar to that in example 1.

TABLE 4

| | ratio of area occupied by superabrasive | average grain size of superabrasive | areal ratio of | difference in level between projection & depression of tip of superabrasive | thickness of binder relative to average | variation in height of tips working on | wheel performance | | |
|---|---|---|---|---|---|---|---|---|---|
| sample no. | grains (%) | grain (μm)) | working tip (%) | grain (μm) | grain size (%) | workpiece (μm) | surface roughness of workpiece | grinding performance | lifetime |
| 50 | 40 | 200 | 15 | 1 | 50 | 1 | A | A | A |
| 51 | 40 | 200 | 15 | 0.8 | 50 | 1 | A | B | B |

The wheels underwent a grinding test to grind workpieces under conditions indicated below, and the workpieces had surface roughnesses as shown in Table 4.

Further, the workpieces and the wheels had their respective surfaces observed to assess grinding performance and lifetime.

Workpiece: Steel (hardness: HRC55)

Wheel's peripheral speed: 60 m/s

Feed rate: 700 mm/min

Grinding test period of time: 5 hours

This cutting condition was a severe grinding condition because it is a higher peripheral wheel speed and a higher feed rate than in Example 1. Table 4 has a column "wheel performance" and thereunder a subordinate column "workpiece surface roughness," and therein assessment A indicates that a workpiece had a surface roughness of Rz 5 μm or less. It has been found that a wheel with assessment A shows an extremely excellent effect.

Table 4 under the column "wheel performance" has a subordinate column "grinding performance," and therein assessment A indicates that a workpiece was not burnt. Assessment B indicates that a workpiece was slightly burnt. It has been found that a wheel with assessment A shows an extremely excellent grinding performance. It has been found that a wheel with assessment B shows an excellent grinding performance.

In a column "lifetime," assessments A and B are defined as follows:

When a grinding process using the wheel of each sample number ends, a lifetime of the wheel is estimated from a shape of a tip. Assessment A indicates a relative lifetime of "0.8 or more" when sample No. 51 has a lifetime of "1". Assessment B indicates a relative lifetime "less than 0.8" when sample No. 51 has a lifetime of "1".

It has been found that a wheel with assessment A shows an extremely excellent lifetime. It has been found that a wheel with assessment B shows an excellent lifetime.

From Table 4, a superabrasive grain having a tip with a depression and a projection having a larger difference in level is preferable.

EXAMPLE 5

Electroplated CBN grinding wheels of Sample Nos. 60-65 shown in table 5 were produced in a method similar to that in example 1.

TABLE 5

| | ratio of area occupied by superabrasive | average grain size of superabrasive | areal ratio of | difference in level between projection & depression of tip of superabrasive | thickness of binder relative to average | variation in height of tips working on | wheel performance | | |
|---|---|---|---|---|---|---|---|---|---|
| sample no. | grains (%) | grain (μm) | working tip (%) | grain (μm) | grain size (%) | workpiece (μm) | surface roughness of workpiece | grinding performance | lifetime |
| 60 | 50 | 140 | 10 | 2 | 92 | 1 | B | C | B |
| 61 | 50 | 140 | 10 | 2 | 90 | 1 | A | B | A |
| 62 | 50 | 140 | 10 | 2 | 80 | 1 | A | A | A |

TABLE 5-continued

| sample no. | ratio of area occupied by superabrasive grains (%) | average grain size of superabrasive grain (μm) | areal ratio of working tip (%) | difference in level between projection & depression of tip of superabrasive grain (μm) | thickness of binder relative to average grain size (%) | variation in height of tips working on workpiece (μm) | wheel performance: surface roughness of workpiece | wheel performance: grinding performance | wheel performance: lifetime |
|---|---|---|---|---|---|---|---|---|---|
| 63 | 50 | 140 | 10 | 2 | 60 | 1 | A | A | A |
| 64 | 50 | 140 | 10 | 2 | 30 | 1 | A | A | A |
| 65 | 50 | 140 | 10 | 2 | 28 | 1 | A | A | C |

The wheels underwent a grinding test to grind workpieces under conditions indicated below, and the workpieces had surface roughnesses as shown in Table 5.

Further, the workpieces and the wheels had their respective surfaces observed to assess grinding performance and lifetime.

Workpiece: Steel (hardness: HRC55)

Wheel's peripheral speed: 50 m/s

Feed rate: 650 mm/min

Grinding test period of time: 5 hours

This cutting condition was a severe grinding condition because it is a higher feed rate than in Example 1. Table 5 has a column "wheel performance" and thereunder a subordinate column "workpiece surface roughness," and therein assessment A indicates that a workpiece had a surface roughness of Rz 5 μm or less. Assessment B indicates that a workpiece had a surface roughness exceeding Rz 5 μm and equal to or less than Rz 7 μm. It has been found that a wheel with assessment A shows an extremely excellent effect. It has been found that a wheel with assessment B shows an excellent effect.

Table 5 under the column "wheel performance" has a subordinate column "grinding performance," and therein assessment A indicates that a workpiece was not burnt. Assessment B indicates that a workpiece was slightly burnt. Assessment C indicates that a workpiece was apparently burnt. It has been found that a wheel with assessment A shows an extremely excellent grinding performance. It has been found that a wheel with assessment B shows an excellent grinding performance. It has been found that although a wheel with assessment C burns a workpiece, the wheel can be used in a field where burning is not a problem.

In a column "lifetime," assessments A-C are defined as follows:

When a grinding process using the wheel of each sample number ends, a lifetime of the wheel is estimated from a shape of a tip. Assessment A indicates a relative lifetime of "0.8 or more" when sample No. 62 has a lifetime of "1". Assessment B indicates a relative lifetime "less than 0.8" when sample No. 62 has a lifetime of "1". Assessment C indicates a relative lifetime "less than 0.6" when sample No. 62 has a lifetime of "1".

It has been found that a wheel with assessment A shows an extremely excellent lifetime. It has been found that a wheel with assessment B shows an excellent lifetime. It has been found that a wheel with assessment C shows a normal lifetime.

From Table 5, it has been found that a thickness of a binder relative to an average grain size is preferably 30% or more and 90% or less, and most preferably 30% or more and 80% or less.

EXAMPLE 6

Electroplated CBN grinding wheels of Sample Nos. 70-74 shown in table 6 were produced in a method similar to that in example 1. Note, however, that while in Embodiment 1, the superabrasive grains were fixed by plating, in Sample Nos. 70-74, superabrasive grains were fixed with a brazing material.

TABLE 6

| sample no. | ratio of area occupied by superabrasive grains (%) | average grain size of superabrasive grain (μm) | areal ratio of working tip (%) | difference in level between projection & depression of tip of superabrasive grain (μm) | thickness of binder relative to average grain size (%) | variation in height of tips working on workpiece (μm) | wheel performance: surface roughness of workpiece | wheel performance: grinding performance | wheel performance: lifetime |
|---|---|---|---|---|---|---|---|---|---|
| 70 | 30 | 200 | 5 | 2 | 50 | 7 | B | A | B |
| 71 | 30 | 200 | 5 | 2 | 50 | 5 | A | A | A |
| 72 | 30 | 200 | 5 | 2 | 50 | 3 | A | A | A |
| 73 | 30 | 200 | 5 | 2 | 50 | 1 | A | A | A |
| 74 | 30 | 200 | 5 | 2 | 50 | 0.5 | A | B | A |

The wheels underwent a grinding test to grind workpieces under conditions indicated below, and the workpieces had surface roughnesses as shown in Table 6.

Further, the workpieces and the wheels had their respective surfaces observed to assess grinding performance and lifetime.

Workpiece: Steel (hardness: HRC55)

Wheel's peripheral speed: 70 m/s

Feed rate: 700 mm/min

Grinding test period of time: 5 hours

This cutting condition was a severe grinding condition because it is a higher peripheral wheel speed and a higher feed rate than in Example 1. Table 6 has a column "wheel performance" and thereunder a subordinate column "workpiece surface roughness," and therein assessment A indicates that a workpiece had a surface roughness of Rz 5 μm or less. Assessment B indicates that a workpiece had a surface roughness exceeding Rz 5 μm and equal to or less than Rz 7 μm. It has been found that a wheel with assessment A shows an extremely excellent effect. It has been found that a wheel with assessment B shows an excellent effect.

Table 6 under the column "wheel performance" has a subordinate column "grinding performance," and therein assessment A indicates that a workpiece was not burnt. Assessment B indicates that a workpiece was slightly burnt. It has been found that a wheel with assessment A shows an extremely excellent grinding performance. It has been found that a wheel with assessment B shows an excellent grinding performance.

In a column "lifetime," assessments A and B are defined as follows:

When a grinding process using the wheel of each sample number ends, a lifetime of the wheel is estimated from a shape of a tip. Assessment A indicates a relative lifetime of "0.8 or more" when sample No. 71 has a lifetime of "1". Assessment B indicates a relative lifetime "less than 0.8" when sample No. 71 has a lifetime of "1".

It has been found that a wheel with assessment A shows an extremely excellent lifetime. It has been found that a wheel with assessment B shows an excellent lifetime.

From Table 6, it has been found that a thickness of a binder relative to an average grain size is 1 μm or more and 5 μm or less.

Thus while the present invention has been described in embodiments and examples, the embodiments and examples described herein can be variously modified. Specifically, when the present invention is applied to a CBN grinding wheel used for mass-producing steel parts of various machines and steel parts of automobiles by grinding, highly precise machining results can be obtained and in addition, stable, satisfactory grinding performance can also be obtained and a long lifetime is obtained. Furthermore, the present invention may be applied to a diamond grinding wheel. The above wheel can also be used in a field of superabrasive grinding tools, e.g., a superabrasive grinding wheel used for grinding a workpiece by formed grinding or the like, and a superabrasive polishing wheel.

It should be understood that the embodiments and examples disclosed herein have been described for the purpose of illustration only and in a non-restrictive manner in any respect. The scope of the present invention is defined by the terms of the claims, rather than the embodiments described above, and is intended to include any modifications within the meaning and scope equivalent to the terms of the claims.

REFERENCE SIGNS LIST

1: super abrasive wheel; 10: super abrasive grain layer; 100: binder; 101, 102, 103: superabrasive grain; 101*a*, 102*a*, 103*a*: tip; 101*b*, 103*b*: projection and depression; 110: base metal.

The invention claimed is:

1. A superabrasive wheel having a superabrasive grain layer having CBN abrasive grains fixed by a binder, a ratio of an area occupied by the CBN abrasive grains in the superabrasive grain layer being 20% to 70%, an area ratio at which the CBN abrasive grains' tips work on a workpiece being 1% to 30% per unit area of a surface of the superabrasive grain layer, the superabrasive grain layer having the CBN abrasive grains fixed in a single layer, the binder being metal plating or a brazing material.

2. The superabrasive wheel according to claim 1, wherein the CBN abrasive grain has an average grain size of 5 μm to 2000 μm.

3. The superabrasive wheel according to claim 1, wherein a projection and a depression having a height of 1 μm or more are formed at a tip of the CBN abrasive grain.

4. The superabrasive wheel according to claim 1, wherein the binder has a thickness of 30% to 90% of an average grain size of the CBN abrasive grain.

5. The superabrasive wheel according to claim 1, wherein a plurality of the CBN abrasive grains work on a workpiece, and the plurality of the CBN abrasive grains working on the workpiece have tips, respectively, having a variation in height of 5 μm or less.

6. The superabrasive wheel according to claim 1, used for precision grinding in which a surface roughness of a workpiece is 5 μm Rz or less.

7. The superabrasive wheel according to claim 1, wherein the ratio of the area occupied by the CBN abrasive grains in the superabrasive grain layer is 30% to 70%.

8. The superabrasive wheel according to claim 1, wherein the binder has a thickness of 30% to 80% of an average grain size of the CBN abrasive grain.

* * * * *